US009354581B2

(12) United States Patent
Saeki

(10) Patent No.: US 9,354,581 B2
(45) Date of Patent: May 31, 2016

(54) SHEET PROCESSING APPARATUS THAT PAUSES SHEET EJECTION TO PREVENT A SHEET FROM ADHERING TO A PREVIOUS SHEET

(75) Inventor: Naoto Saeki, Abiko (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 13/450,686

(22) Filed: Apr. 19, 2012

(65) Prior Publication Data

US 2012/0201586 A1 Aug. 9, 2012

Related U.S. Application Data

(62) Division of application No. 12/203,388, filed on Sep. 3, 2008, now Pat. No. 8,285,193.

(30) Foreign Application Priority Data

Sep. 13, 2007 (JP) ..... 2007-238590

(51) Int. Cl.
*G03G 15/00* (2006.01)

(52) U.S. Cl.
CPC ..... *G03G 15/6573* (2013.01); *G03G 15/5062* (2013.01); *B65H 2404/68* (2013.01); *B65H 2601/273* (2013.01); *G03G 2215/00421* (2013.01); *G03G 2215/00827* (2013.01)

(58) Field of Classification Search
CPC ..... G03G 15/6573; G03G 2215/00421; G03G 2215/00755; B65H 29/68; B65H 2404/68; B65H 2601/273
USPC ..... 399/405, 33
See application file for complete search history.

(56) References Cited

U.S. PATENT DOCUMENTS

| | | | | |
|---|---|---|---|---|
| 4,844,633 | A * | 7/1989 | Greenberg | 400/625 |
| 5,303,017 | A * | 4/1994 | Smith | 399/403 |
| 6,233,427 | B1 * | 5/2001 | Hirota et al. | 399/407 |
| 6,324,357 | B1 | 11/2001 | Gomi et al. | |
| 6,788,905 | B2 | 9/2004 | Tsutada | |
| 7,313,355 | B2 * | 12/2007 | Isobe et al. | 399/341 |
| 7,349,645 | B2 | 3/2008 | Ohnishi et al. | |

(Continued)

FOREIGN PATENT DOCUMENTS

| | | | |
|---|---|---|---|
| JP | 08-149265 | A | 6/1996 |
| JP | 08149265 | A * | 6/1996 |

(Continued)

OTHER PUBLICATIONS

Notice of Reason for Rejection, dated Jan. 17, 2012, in Japanese Patent Application No. 2007-238590.
Japanese Office Action issued in counterpart application 2012-25663, dated Oct. 8, 2013.

*Primary Examiner* — Daniel J Colilla
*Assistant Examiner* — Justin Olamit
(74) *Attorney, Agent, or Firm* — Fitzpatrick, Cella, Harper & Scinto

(57) ABSTRACT

A sheet processing apparatus of the invention has: an ejecting unit that is capable of receiving a sheet on which a toner image has been heated and fixed, and ejecting the sheet for a predetermined normal ejecting time; and a processing unit that processes the sheet ejected by the ejecting unit according to obtained sheet information, wherein the ejecting unit ejects the sheet for an ejecting time longer than the normal ejecting time.

25 Claims, 12 Drawing Sheets

(56) References Cited

U.S. PATENT DOCUMENTS

| | | | | |
|---|---|---|---|---|
| 7,451,980 | B2 | 11/2008 | Tamura et al. | |
| 7,937,002 | B2 | 5/2011 | Ishikawa | |
| 2002/0063580 | A1 | 5/2002 | Esch | |
| 2003/0122299 | A1 * | 7/2003 | Soga et al. | 271/182 |
| 2003/0132977 | A1 | 7/2003 | Moto et al. | |
| 2003/0156850 | A1 | 8/2003 | Tsutada | |
| 2004/0174551 | A1 * | 9/2004 | Kurohata et al. | 358/1.12 |
| 2005/0230898 | A1 * | 10/2005 | Suqiyama et al. | 270/58.08 |
| 2007/0102874 | A1 * | 5/2007 | Matsutomo et al. | 271/286 |
| 2008/0303007 | A1 | 12/2008 | Drinkhorn | |
| 2009/0060615 | A1 | 3/2009 | Hosoda | |

FOREIGN PATENT DOCUMENTS

| | | | | |
|---|---|---|---|---|
| JP | 9-208099 | | | 8/1997 |
| JP | 2002-268305 | | | 9/2002 |
| JP | 2003-248349 | | | 9/2003 |
| JP | 2004-294651 | | | 10/2004 |
| JP | 2005157176 | A | * | 6/2005 |
| JP | 2006-243498 | | | 9/2006 |
| JP | 2006243498 | A | * | 9/2006 |
| JP | 2007-062970 | | | 3/2007 |
| JP | 2007-076864 | A | | 3/2007 |
| JP | 2009-58787 | A | | 3/2009 |

* cited by examiner

SHEET PROCESSING APPARATUS THAT PAUSES SHEET EJECTION TO PREVENT A SHEET FROM ADHERING TO A PREVIOUS SHEET

This application is a divisional of U.S. patent application Ser. No. 12/203,388, filed Sep. 3, 2008, and currently pending.

BACKGROUND OF THE INVENTION

1. Field of the Invention

The present invention relates to a sheet processing apparatus for ejecting sheets at such intervals that the sheets on which toner images have been formed are difficult to be adhered by the toner images and to an image forming apparatus having such a sheet processing apparatus in an apparatus main body.

2. Description of the Related Art

An image forming apparatus is an apparatus for forming an image onto a sheet. As image forming apparatuses, for example, there are a copying apparatus, a printer, a facsimile apparatus, a hybrid apparatus (multi-function apparatus) having multi-functions of those apparatuses, and the like. Among the image forming apparatuses, there is an image forming apparatus of a type in which a sheet processing apparatus for processing sheets on which images have been formed is provided in an apparatus main body or is provided as an option for the outside of the apparatus main body.

A certain type of image forming apparatus heats and fixes a toner image onto the sheet thereby forms the image on the sheet. According to such an image forming apparatus, there is a case where after the toner image was heated and fixed onto the sheet, the sheet is fed to the sheet processing apparatus before the toner image is solidified.

There is, consequently, a case where the stacked sheets are adhered by the toner images (hereinbelow, such a phenomenon is referred to as "discharge adhesion") and when the sheets are separated, the sheet is torn or the toner image is dropped out.

As a sheet stacking apparatus which can cope with such a problem, there is an apparatus having a fan adapted to blow the air to the sheets stacked on a stacking tray in order to solidify the toner images by actively cooling the sheets (Japanese Patent Application Laid-Open No. 2007-76864).

SUMMARY OF THE INVENTION

However, according to the sheet processing apparatus in the related art, since the fan is used in order to cool the sheets, a large fan or a plurality of fans has to be attached in order to assure a cooling effect. There is consequently such a problem that costs of the apparatus rise remarkably, a space adapted to mount the fan/fans is necessary, the apparatus enlarges in size, and noises are increased due to the mounting of the fan/fans.

Therefore, in order to cool the sheets without using any fan, it would be effective to convey a sheet while releasing heat from the sheet in a long conveying path. However, according to such a construction, since the sheet conveying path is long, another problem occurs. That is, an occurrence ratio of a jam rises and the sheet processing apparatus enlarges.

Moreover, the image forming apparatus having the large sheet processing apparatus also enlarges in size.

An object of the invention is to provide a sheet processing apparatus for cooling a sheet without using a fan for cooling the sheet or without extending a sheet conveying path.

Another object of the invention is to provide an image forming apparatus which has a sheet processing apparatus that can cool a sheet without enlarging the apparatus itself, thereby preventing the apparatus from enlarging in size.

According to the invention, there is provided a sheet processing apparatus comprising: an ejecting unit that is capable of receiving a sheet on which a toner image has been heated and fixed, and ejecting the sheet for a predetermined normal ejecting time; and a processing unit configured to process the sheet ejected by the ejecting unit, wherein the ejecting unit ejects the sheet for an ejecting time longer than the normal ejecting time according to obtained sheet information.

According to the invention, there is provided an image forming apparatus comprising: an image forming unit that forms a toner image onto a sheet; a fixing unit that fixes the toner image formed on the sheet by the image forming unit by heating the sheet; and an ejecting unit that is capable of receiving the sheet on which the toner image has been heated and fixed, and ejecting the sheet for a predetermined normal ejecting time, wherein the ejecting unit ejects the sheet for an ejecting time longer than the normal ejecting time according to obtained sheet information.

According to the sheet processing apparatus and the image forming apparatus of the invention, the ejecting unit ejects the sheet so that the ejecting time becomes longer than the normal ejecting time at the time when the sheet is ejected in one direction at a predetermined speed. Therefore, according to the sheet processing apparatus and the image forming apparatus of the invention, since there is no need to use any fan and extend a sheet conveying path, the sheet can be effectively cooled and an adhesion of the sheets can be prevented while avoiding an enlargement of the apparatus and an increase in operation sound.

Further features of the present invention will become apparent from the following description of exemplary embodiments with reference to the attached drawings.

BRIEF DESCRIPTION OF THE DRAWINGS

FIG. 3 is seen from the right side, in which FIG. 6A is a diagram illustrating a state where the sheet has been fed to the sheet processing apparatus and FIG. 6B is a diagram illustrating a state just before a trailing edge of the sheet is ejected to the processing tray.

FIGS. 7A and 7B are diagrams for describing the operation at the time when a processing roller aligns the trailing edge of the sheet, in which FIG. 7A is a diagram illustrating a state where the sheet approaches a trailing edge restricting plate and FIG. 7B is a diagram illustrating a state where the sheet is in contact with the trailing edge restricting plate.

DESCRIPTION OF THE EMBODIMENTS

A sheet processing apparatus and an image forming apparatus according to an embodiment of the invention will be described with reference to the drawings.

Figure 1:
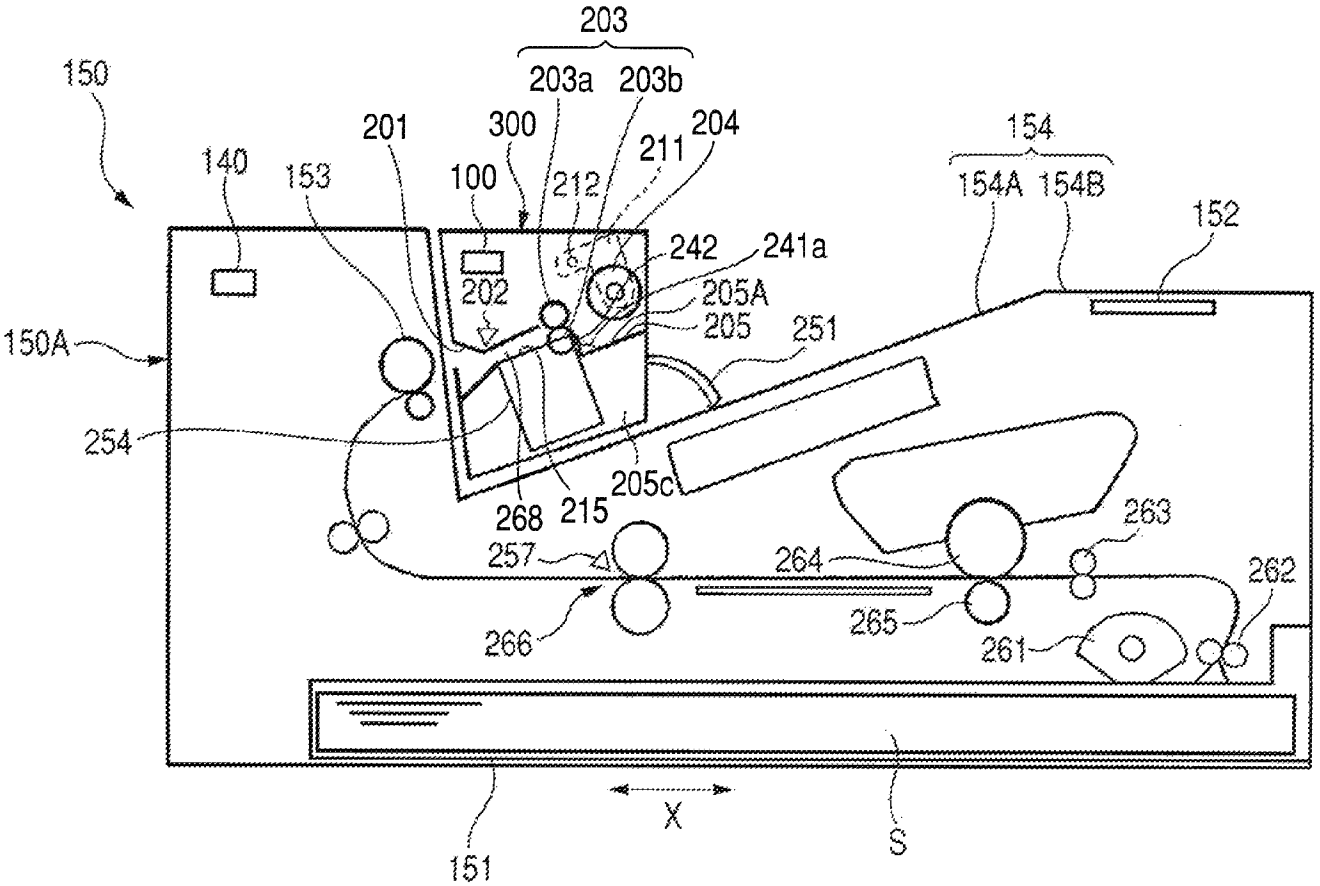
FIG. 1 is a cross sectional view taken along a sheet conveying direction of an image forming apparatus according to an embodiment of the invention.

In the description of the embodiment, a sheet conveying direction indicates a right/left direction in FIG. 1. A sheet ejecting direction indicates a direction from the left to the right in FIG. 1. A trailing edge of the sheet denotes an edge on an upstream side in the sheet conveying direction and is also referred to as an upstream edge. A leading edge of the sheet denotes an edge on a downstream side in the sheet conveying direction and is also referred to as a downstream edge. A side edge of the sheet denotes an edge along the sheet conveying direction. A lateral direction of the sheet denotes a direction perpendicular to the sheet conveying direction and along the surface of the sheet. A vertical direction indicates a vertical direction in FIG. 1. In each diagram, an arrow X indicates the sheet conveying direction, an arrow Y indicates the sheet lateral direction, and an arrow Z indicates the vertical direction.

(Image Forming Apparatus)

Figure 2:
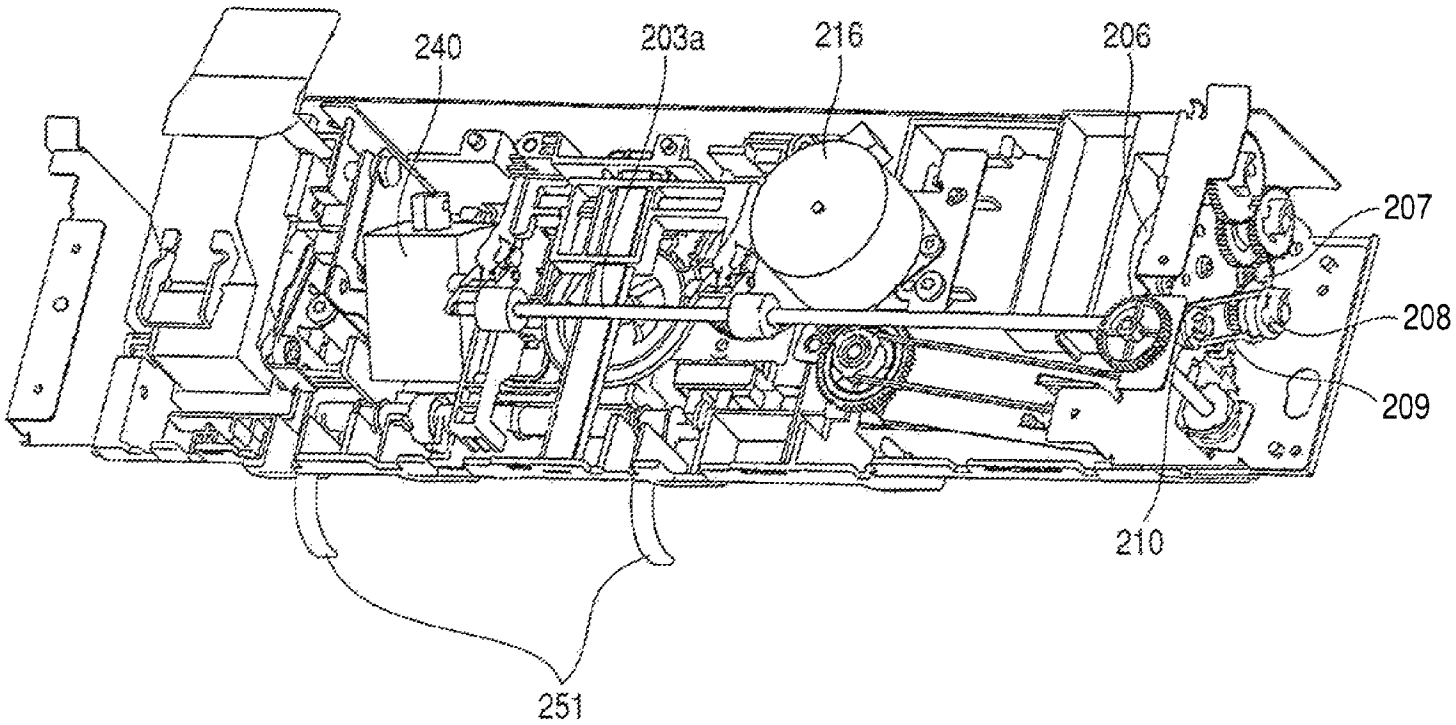
FIG. 2 is a perspective view of a sheet processing apparatus provided for an apparatus main body of the image forming apparatus in FIG. 1 in a state where an upper half of the sheet processing apparatus has been cut away.

FIG. 1 is a cross sectional view taken along the sheet conveying direction of the image forming apparatus in the embodiment of the invention. FIG. 2 is a perspective view of the sheet processing apparatus in a state where an upper half of the sheet processing apparatus has been cut away. A driving roller 203*a* is provided on a lower half side. An image forming apparatus 150 is an apparatus for forming an image onto a sheet. As an image forming apparatus 150, for example, there is a copying apparatus, a printer, a facsimile apparatus, or a hybrid apparatus (multi-function apparatus) of those apparatuses. In the image forming apparatus 150, an apparatus main body 150A for forming an image onto the sheet has a sheet processing apparatus 300 for processing the sheet on which the image has been formed.

The sheet processing apparatus 300 has been connected as a purchase selection item (what is called an option) to the apparatus main body 150A of the image forming apparatus. The sheet processing apparatus 300 may be built in the apparatus main body 150A. The sheet processing apparatus 300 can execute a process for align edges of a sheet bundle (hereinbelow, referred to as "alignment") and a process for binding the sheet bundle.

The apparatus main body 150A of the image forming apparatus 150 forms the image onto the sheet based on information which is transmitted from an outside. A sheet cassette 151 in which the sheets had been enclosed has been mounted in a lower portion of the apparatus main body 150A so that it can be freely pulled out to the right in FIG. 1. Sheets S in the sheet cassette 151 are picked up and fed out one by one from the sheet cassette 151 by a pickup roller 261. The sheet is sent to a position between a photosensitive drum 264 serving as an image forming unit and a transfer roller 265 by a conveying roller pair 262 and a registration roller pair 263. A toner image has previously been formed on the photosensitive drum 264. Therefore, the toner image on the photosensitive drum 264 is transferred onto the sheet. The sheet S onto which the toner image has been transferred is heated and pressed by, for example, a fixing device 266 serving as a fixing unit and the toner image is fixed on the sheet S. After that, the sheet S is conveyed to the sheet processing apparatus 300 by a discharge roller pair 153. The sheet processed by the sheet processing apparatus 300 is ejected onto a tray 154.

The tray 154 is formed by: for example, a tray inclined portion 154A serving as a sheet stacking surface whose downstream side in the sheet ejecting direction is highly inclined; and a tray horizontal portion 154B serving as a horizontal sheet stacking surface sequel to the tray inclined portion 154A.

The apparatus main body 150A and the sheet processing apparatus 300 are made operative when the user operates an operation panel 152 provided for the apparatus main body 150A. The apparatus main body 150A is controlled by a control unit 140.

(Sheet Processing Apparatus)

The sheet processing apparatus 300 operates in such a manner that the sheets received in a sheet receiving portion 201 from the apparatus main body 150A are bound in a bundle form on a stacking surface 205A of a processing tray 205, trailing edges and side edges of the sheets are aligned, and thereafter, the aligned sheets are ejected onto the tray 154 equipped on the apparatus main body 150A. There is also a case where after the sheet processing apparatus 300 aligned the trailing edge and side edge of the sheet bundle, the apparatus 300 staples the sheet bundle and ejects the sheet bundle. The processing tray 205 is an example of a stacking unit.

The sheet receiving portion 201 receives the sheet S ejected from the discharge roller pair 153 of the apparatus main body 150A. When the sheet S is ejected to the sheet receiving portion 201, the sheet S is detected by an entrance sensor 202 and, thereafter, conveyed to a conveying roller pair 203 (203*a*, 203*b*) and to a processing roller 204. The sheet S is ejected onto the processing tray 205. The conveying roller pair 203 is an example of an ejecting unit and is a rotor pair which can rotate forwardly and reversely. A belt pair may be used in place of the conveying roller pair 203. The rotor pair is not limited to the roller pair.

The conveying roller pair 203 for ejecting the sheet to the processing tray 205 is constructed by a driving roller 203*a* and a driven roller 203*b*. As illustrated in FIG. 2, the driving roller 203*a* obtains a rotational force from a conveying motor 206 through a conveying motor gear 207, a conveying pulley gear 208, a conveying belt 209, and a conveying pulley 210 attached to the conveying motor 206 and rotates. When the conveying motor 206 rotates forwardly and reversely, the conveying roller pair 203 rotates forwardly and reversely, thereby enabling the sheet to execute the reciprocating operation in the ejecting direction and reverse direction of the sheet.

The processing roller 204 is formed by a cylindrical member and its outer peripheral portion is made of rubber or an elastic member such as a foaming material having elasticity similar to that of the rubber. The processing roller 204 has been held in a processing roller holder 211. The processing roller holder 211 can rotate in the vertical direction around a roller holder axis 212 as a center.

The processing roller 204, processing roller holder 211, and roller holder axis 212 can reciprocate to the downstream side and upstream side in the sheet ejecting direction by a gear mechanism (not shown) mainly constructed by a spur gear train. The processing roller 204 and processing roller holder 211 are guided by the roller holder axis 212 and can reciprocate in the sheet lateral direction by the gear mechanism (not shown). The gear mechanism is provided over a guide path 268.

When the processing roller 204 is moved on the sheet to the downstream side or upstream side by the processing roller holder 211, the processing roller 204 is moved together with the sheet and is not rotated. In the embodiment, when the processing roller 204 is moved on the processing tray 205 in a sheet absent state to the downstream side by the processing roller holder 211, the processing roller 204 is rotated. When the processing roller 204 is returned to the upstream side, the processing roller 204 is not rotated.

In FIG. 1, when the conveying roller pair 203 conveys the sheet S onto the processing tray 205, the processing roller 204 has retreated to an upper position. Therefore, the sheet S is ejected onto the processing tray 205 without being obstructed by the processing roller 204.

The processing roller 204 operates integratedly with the processing roller holder 211. An operating force in this instance is generated from a TD motor 216 in FIG. 2. The TD motor 216 has been mounted under the processing tray 205 and a lower guide 215 of the guide path 268 illustrated in FIG. 1. The foregoing gear mechanism (not shown) for moving the processing roller 204, processing roller holder 211, and roller holder axis 212 has been mounted over the guide path 268.

A stapler 254 has been attached under the guide path 268 and near the processing tray 205.

(Control Block Diagram)

Figure 9:
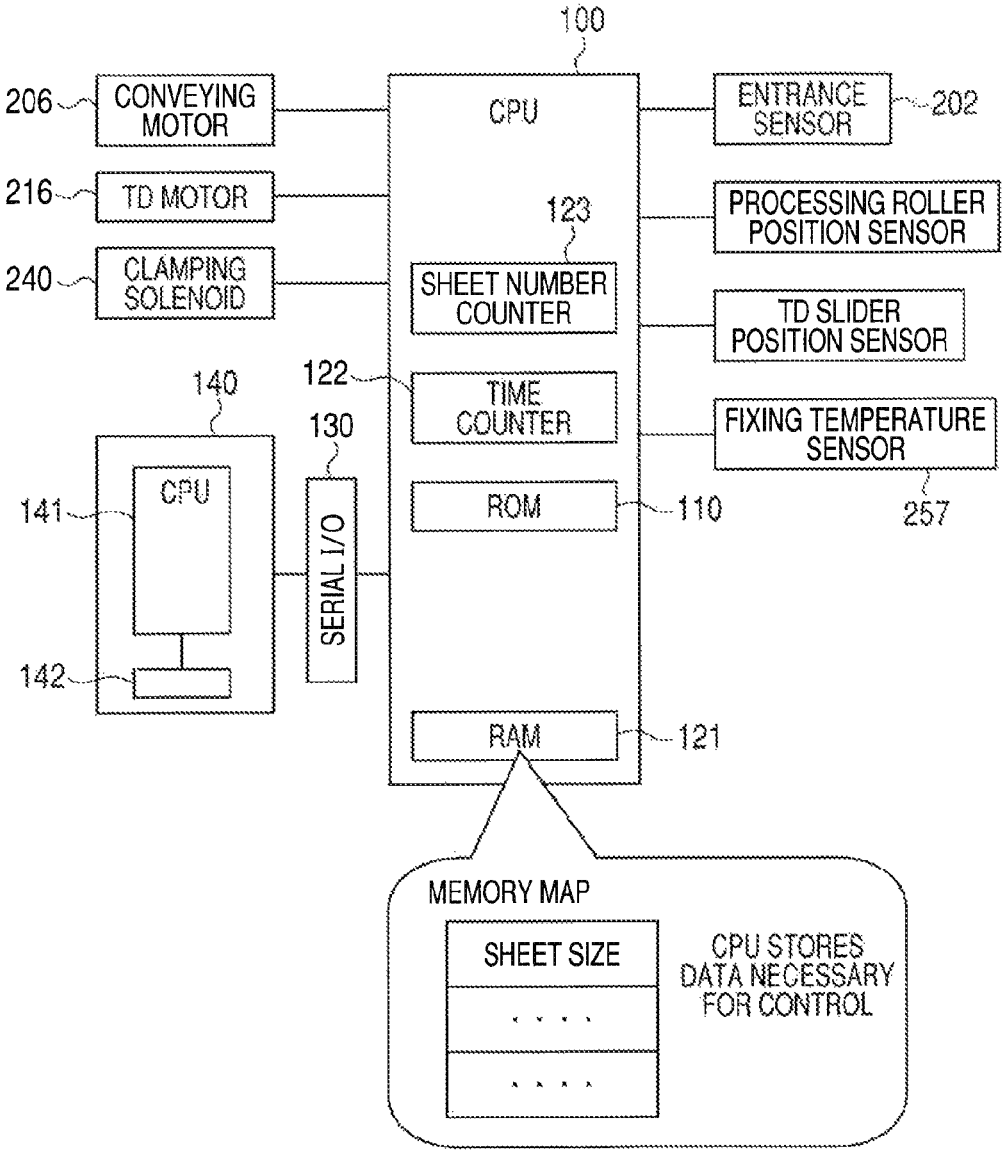
FIG. 9 is a control block diagram of the sheet processing apparatus.

FIG. 9 is a block diagram illustrating a construction of the control unit in the sheet processing apparatus 300 in the embodiment. For example, a CPU 100 serving as a control unit has a ROM 110 therein. Programs corresponding to control procedures illustrated in FIGS. 10 to 12, which will be described hereinafter, and the like have been stored in the ROM 110. The CPU 100 controls each unit while reading out those programs.

The CPU 100 also has a RAM 121 in which work data and input data have been stored. The CPU 100 makes control with reference to the data stored in the RAM 121 based on the programs. The CPU 100 also has a time counter 122 and a sheet number counter 123. The time counter 122 counts a time interval of the sheets which are detected by the entrance sensor 202. The sheet number counter 123 is a counting unit for counting the number of sheets by counting the number of times of sheet detection which is performed by the entrance sensor 202.

The entrance sensor 202, for example, a fixing temperature sensor 257 serving as a fixing temperature measuring unit for measuring a temperature of the fixing device 266, and various kinds of sensors have been connected to input ports of the CPU 100 (FIG. 1).

The conveying motor 206, TD motor 216, and a clamping solenoid 240 have been connected to output ports of the CPU 100 (FIG. 2). Based on detection states of those sensors, the CPU 100 controls loads of various kinds of motors and solenoid connected to the output ports according to the foregoing programs or the like.

The CPU 100 transmits and receives control data to/from the control unit 140 (FIG. 1) of the apparatus main body 150A through a serial interface unit (I/O) 130. The CPU 100 controls each unit based on the control data and sheet information transmitted from the control unit 140.

A print ratio discriminating unit 142 serving as print ratio discriminating means for discriminating a print ratio has been connected to a CPU 141 of the control unit 140.

The print ratio denotes a value obtained by averaging amounts of toner deposited in a region where the sheet image can be formed (image forming area). For example, in the case where the toner image has been formed in the whole image forming area, the print ratio is equal to 100%. If the toner image has been formed in the area which is equal to 25% of the image forming area, the print ratio is equal to 25%. Since a color image is formed by toner of four colors of yellow, cyan, magenta, and black, for example, if the print ratio of each of yellow, cyan, magenta, and black is equal to 25%, the total print ratio is equal to 100%. One of the CPU 100 and the control unit 140 may be built in the other and integrated therewith.

(Sheet Aligning Operation on Processing Tray 205)

Figure 6A:
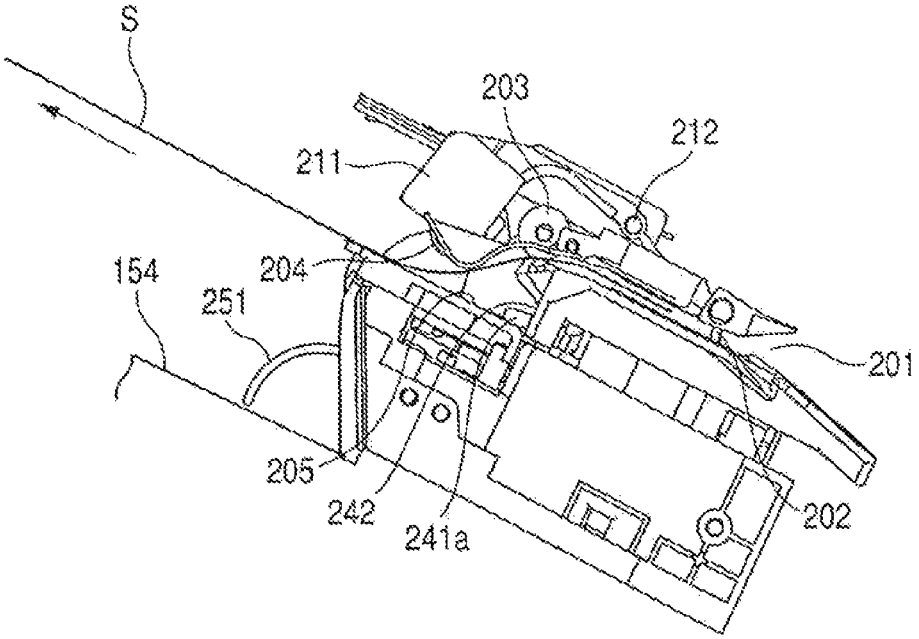
FIGS. 6A and 6B are diagrams illustrating a state of ejecting a sheet bundle in a sheet ejecting direction and are diagrams when
Figure 6B:
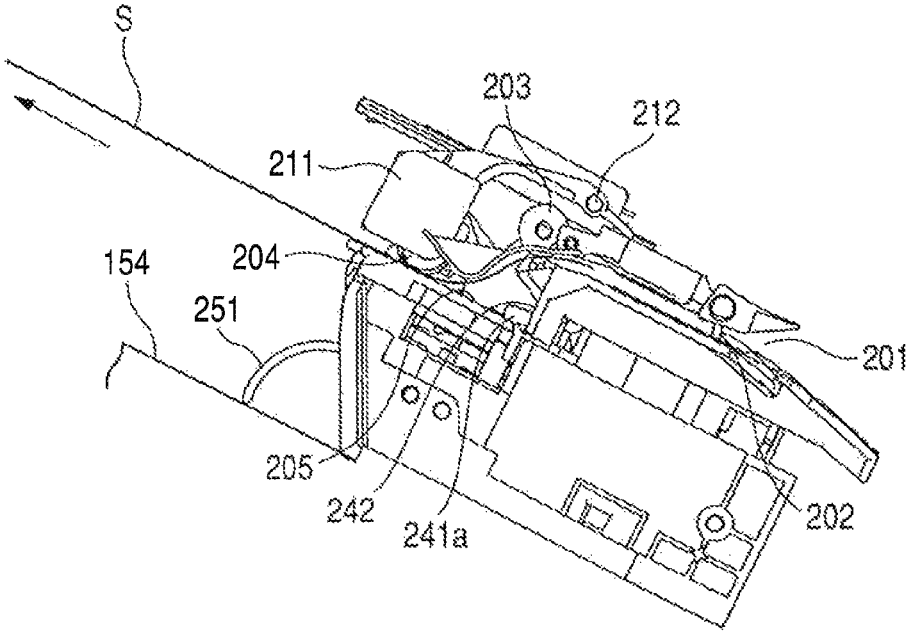

In FIGS. 1 and 9, in the sheet processing apparatus 300, the sheet received from the apparatus main body 150A (FIG. 1) of the image forming apparatus is conveyed to the processing tray 205 by the conveying roller pair 203 (FIG. 6A). The TD motor 216 (FIG. 2) rotates before the sheet exits a nip of the conveying roller pair 203. Thus, while the processing roller 204 is dropped, it is moved in the sheet ejecting direction (downstream side) and conveys the sheet to the downstream side simultaneously with the conveying roller pair 203 (FIG. 6B). The processing roller 204 conveys the sheet to the downstream side without rotating for the processing roller holder 211. Therefore, the processing roller 204 can certainly convey the sheet to the downstream side.

(Reciprocating Operation of Sheet)

If the CPU 100 of the sheet processing apparatus 300 receives a signal indicative of a discharge adhesion preventing mode from the control unit 140 of the image forming apparatus main body, the CPU 100 allow the sheet to reciprocate by the conveying roller pair 203 at a position over the tray 154 as illustrated in FIG. 6A. By executing such an operation, the sheets which have already been stacked on the processing tray 205 or the tray 154 are naturally cooled and, further, the sheet nipped by the conveying roller pair 203 can be also naturally cooled.

Since the sheet reciprocates as mentioned above, when it is intended to convey the sheet by the processing roller 204, a defective alignment that is caused since the toner image on the sheet is adhered to the preceding sheet which has already been stacked onto the processing tray 205 or the tray 154 can be prevented. Since the sheets are not mutually adhered, a problem such as peel-off of the toner image that is caused when the sheets are peeled off, tear-up of the sheet, or the like can be avoided.

In this case, it might be effective that the sheet is stopped and cooled for a predetermined time with the sheet nipped to the conveying roller pair 203. However, if the sheet is stopped for a long time (time longer than about 300 msec), the stopped subsequent sheet is adhered to the preceding sheet which has already been stacked onto the processing tray 205 or the tray 154 for such a period of time. Therefore, even if the subsequent sheet is cooled, the subsequent sheet is in a state where it has been adhered to the preceding sheet. After that even if the user tries to execute the trailing edge aligning operation, the sheets cannot be separated. Therefore, it is desirable to allow the sheet to reciprocate lest the defective alignment occurs.

In the sheet processing apparatus 300, even if the sheet is conveyed to the processing tray 205, by moving the sheet to the upstream side for a short time (time which is equal to or shorter than about 300 msec), the adhesion of the sheets can be prevented. After the sheet was conveyed to the upstream side in the sheet ejecting direction by a predetermined amount, the conveyance in the discharging direction is started in a short time in a manner similar to that mentioned above. The sheet can be effectively cooled by executing the reciprocating operation. By increasing the number of reciprocating times, the cooling effect of the sheet can be improved.

In the reciprocating operation of the sheet, since an interval between the present sheet and the next sheet becomes narrow, in the case of executing the reciprocating operation of the sheet, it is necessary to widen the interval between the sheets by a distance corresponding to the time necessary for the reciprocating operation.

Figure 4:
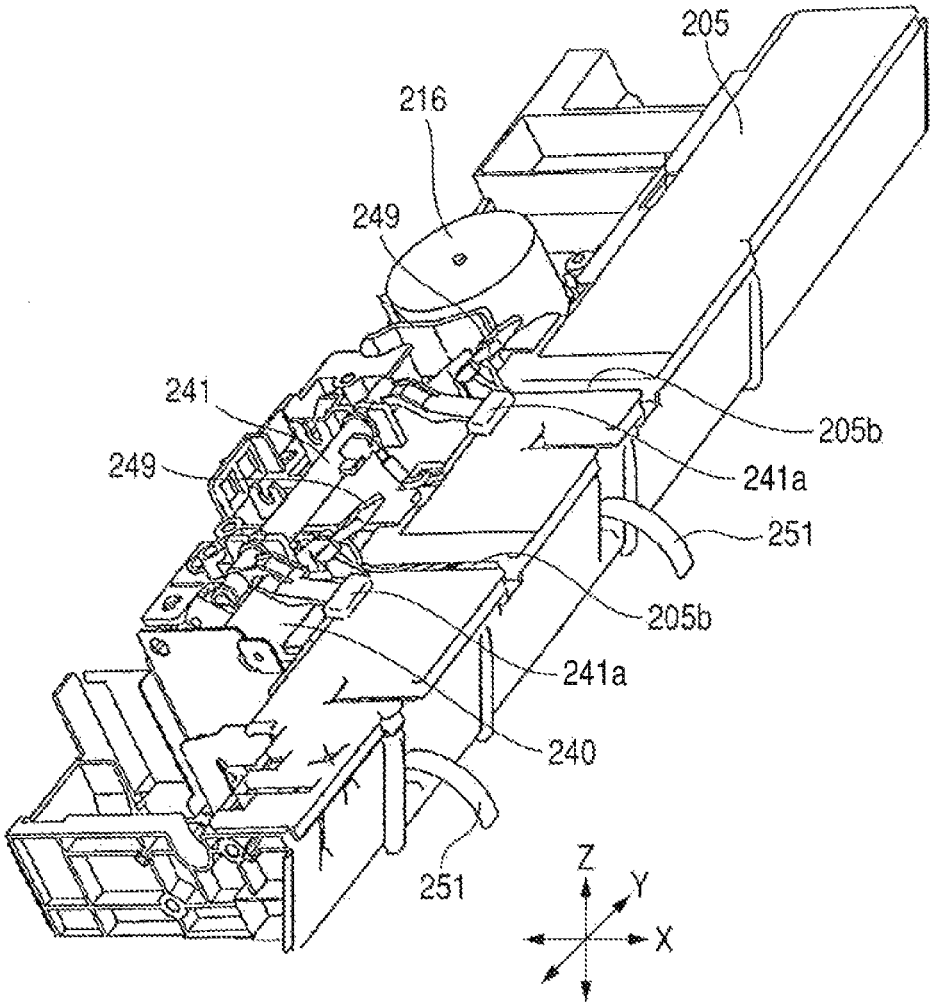
FIG. 4 is a perspective view of a processing tray.
Figure 5:
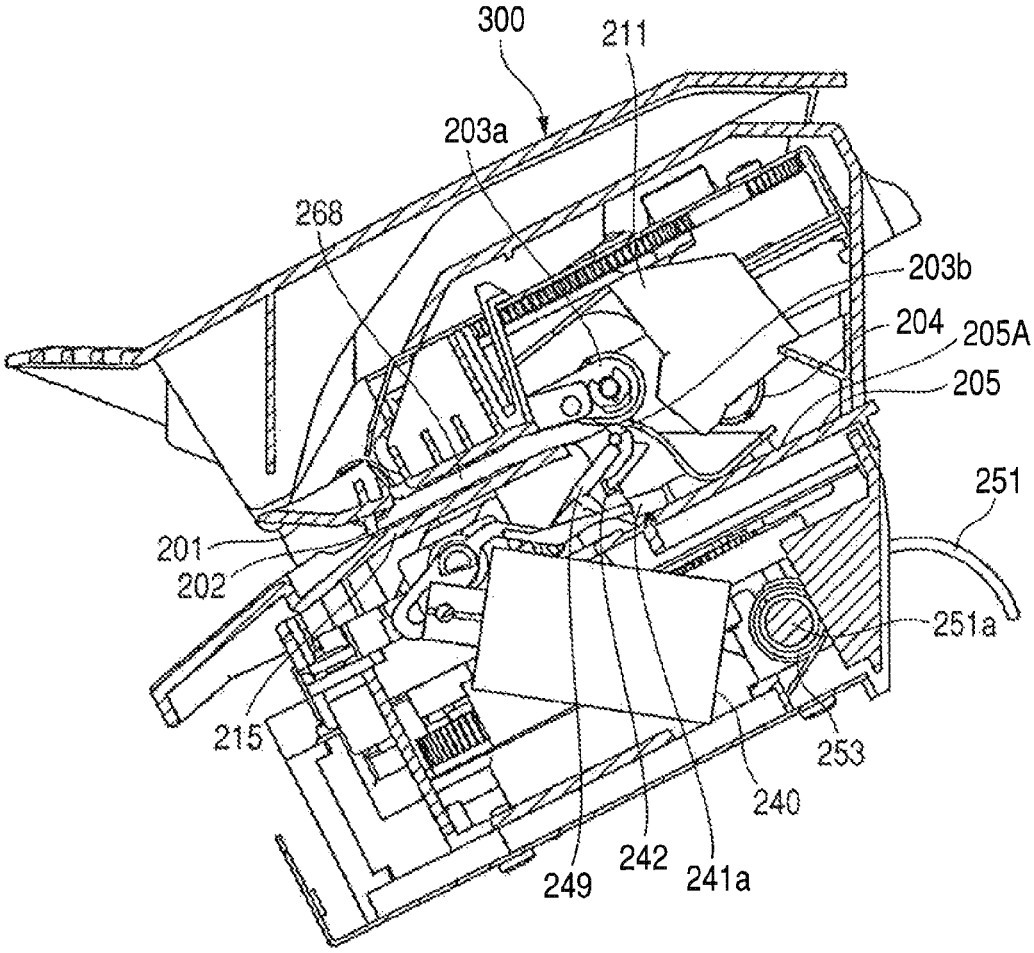
FIG. 5 is a cross sectional view taken along the sheet conveying direction of the sheet processing apparatus provided for the apparatus main body of the image forming apparatus in FIG. 1.
Figure 7A:
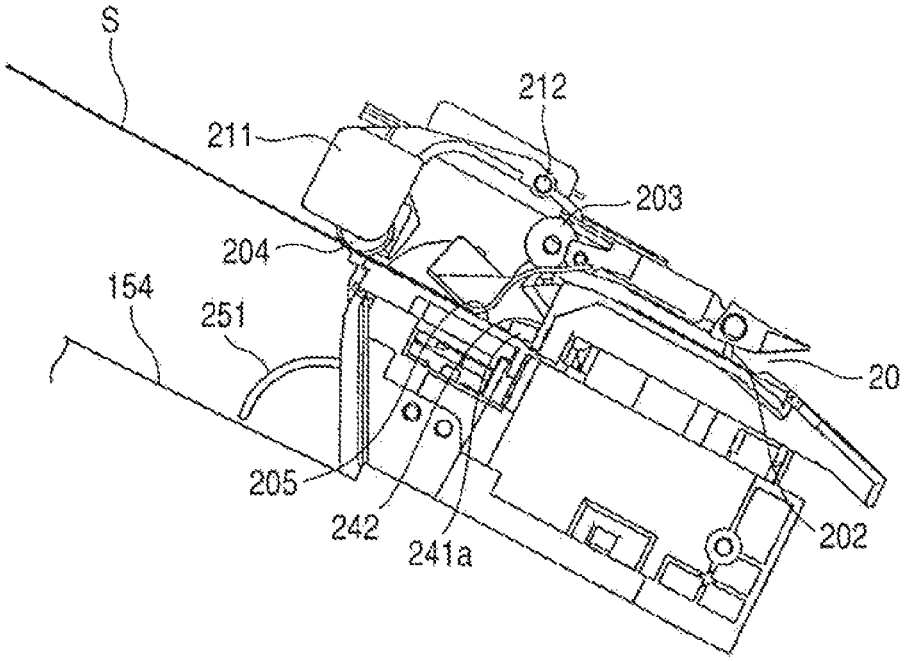
Figure 7B:
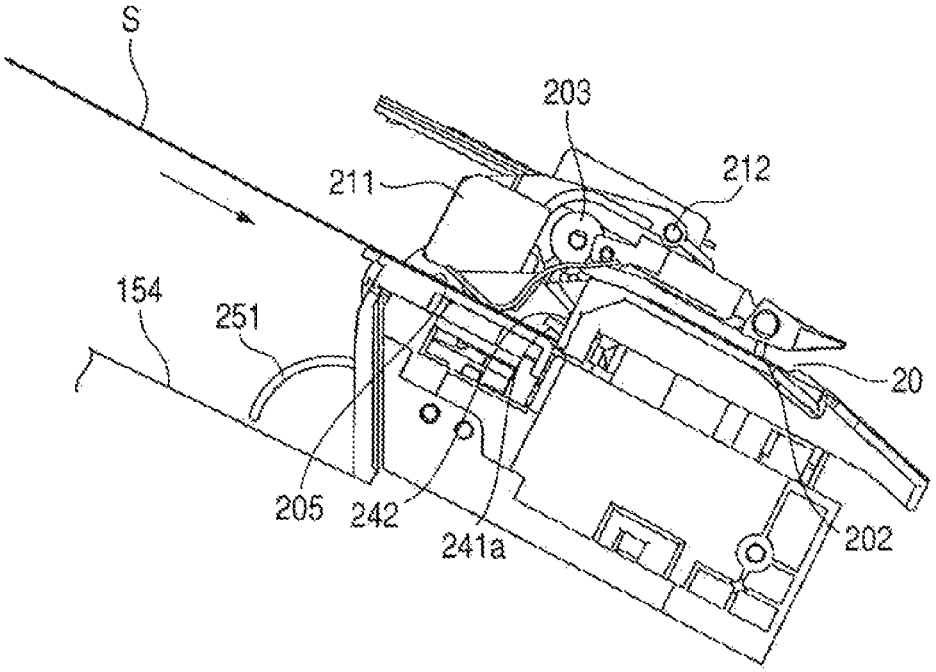

Also after the sheet S exited the nip of the conveying roller pair 203, the processing roller 204 continues to move to the downstream side and arrives at a maximum movement point (FIG. 7A). The processing roller 204 starts the movement so as to approach a trailing edge restricting plate 242. The trailing edge restricting plate 242 is provided in a stairway portion of the conveying roller pair 203 and the processing tray 205. Thus, claws 241*a* retreat upward, thereby allowing the sheet to be received to the trailing edge restricting plate 242 (FIG. 7B). The claws 241*a* are provided for such a purpose that the claws 241*a* press the preceding sheet stacked on the processing tray 205 onto the processing tray 205 and a positional deviation is not caused in the preceding sheet by the subsequent sheet which is ejected. When the clamping solenoid 240 is turned on and a claw axis 241 is rotated, the claws 241*a* (FIG. 4) are rotated in the vertical direction.

Figure 3:
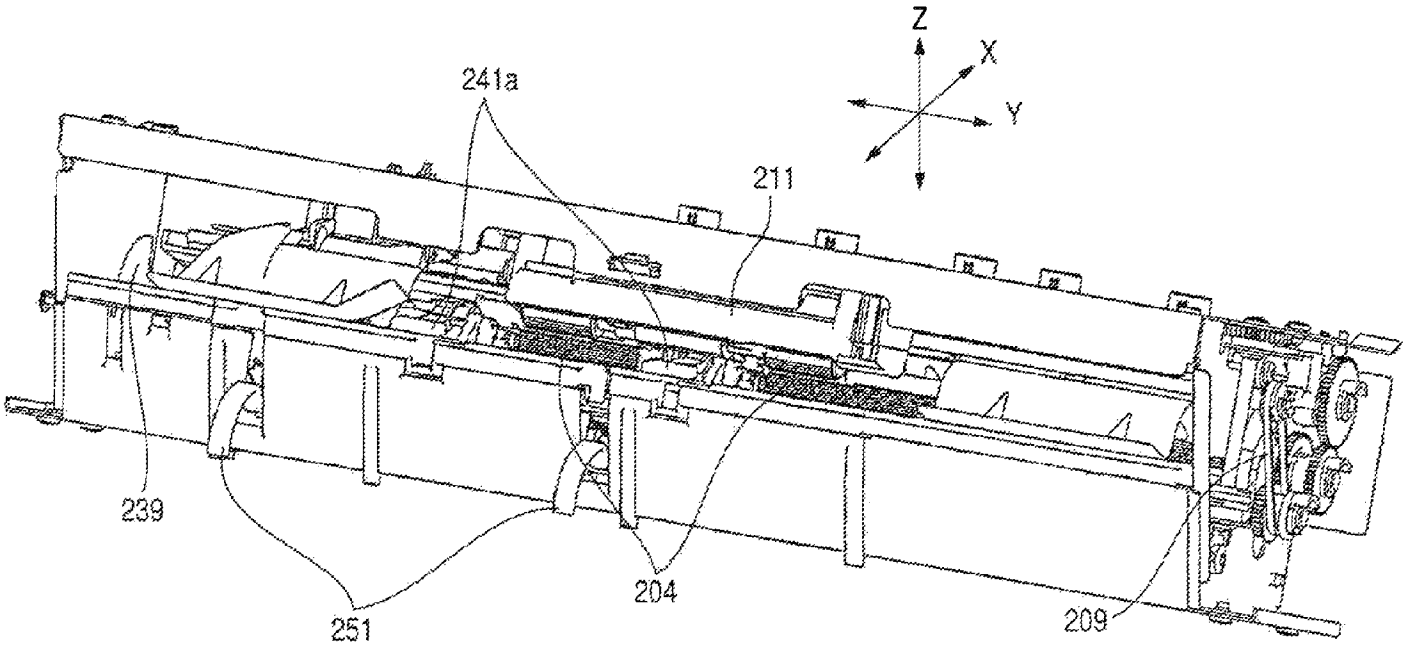
FIG. 3 is a perspective view of the sheet processing apparatus in the embodiment of the invention of FIG. 1 when seen from a sheet ejecting side.

The processing roller 204 hits the sheet against the trailing edge restricting plate 242, slides on the sheet by a small amount (FIG. 7B), and certainly hits the trailing edge of the sheet against the trailing edge restricting plate 242. After that, the processing roller 204 moves so as to approach a lateral regulating plate 239 (FIG. 3), hits the sheet against the lateral regulating plate 239, and slides on the sheet by a small amount. After that, the processing roller 204 retreats upward. The lateral regulating plate 239 is provided at an edge in the lateral direction of the processing tray 205. An upstream side end portion of the sheet subjected to the trailing edge alignment and lateral alignment (side edge alignment) is pressed onto the processing tray 205 by the claws 241*a*. In a state where the processing roller 204 has retreated upward, the processing roller 204 is moved in such a direction as to be away from the lateral regulating plate 239 and returned to a home position. Thus, the aligning operation of the sheet is completed.

Figure 8:
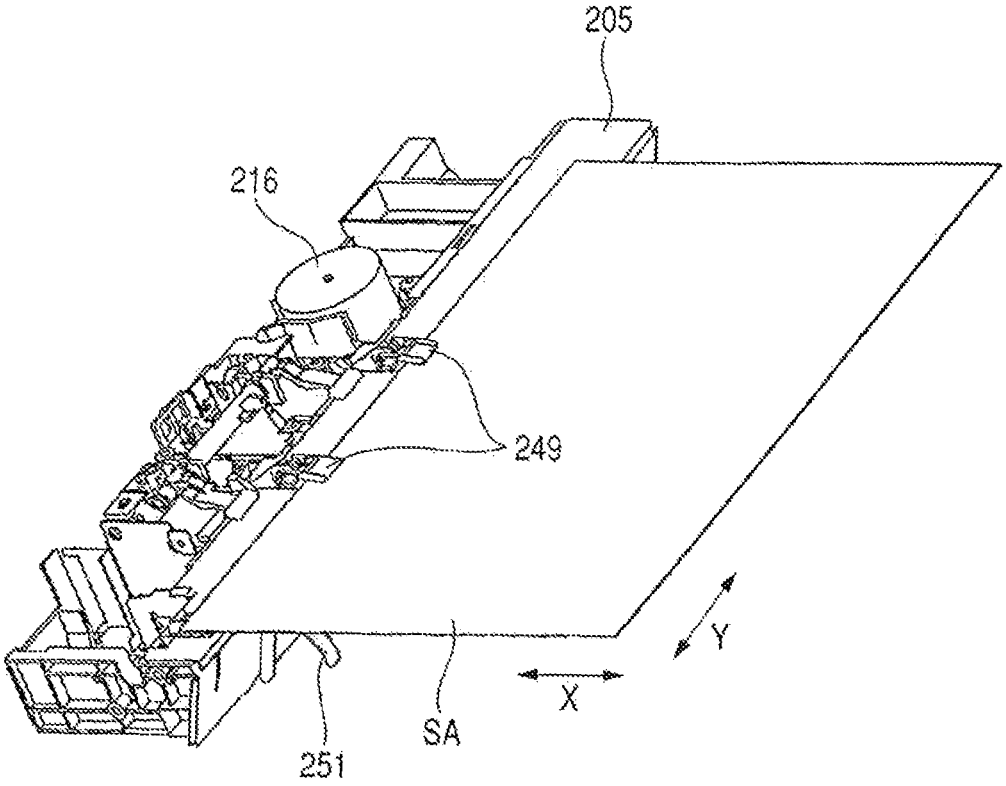
FIG. 8 is a diagram illustrating a state where claws have pressed the sheet onto the processing tray.

The sheet bundle aligned on the processing tray 205 (FIG. 1) is ejected to the tray 154 by claws 249 (FIGS. 4 and 8) which can reciprocate along the sheet ejecting direction. That is, the claws 249 are rotated from upward to downward and press an upstream end portion (FIG. 8) of a sheet bundle SA by a sheet extruding portion. In a state where the sheet bundle SA has been pressed from upward onto the processing tray 205 in this manner, the sheet bundle SA is conveyed to the downstream side. Slits 205*b* (FIG. 4) along the sheet conveying direction are formed in the processing tray 205 in such a manner that the claws 249 press the sheet bundle onto the processing tray 205 and the sheet bundle can be moved to the downstream side.

In FIGS. 1 to 8, a tray sheet pressing member 251 is located above the tray 154 and rotates in the vertical direction. For a time interval until the sheet bundle aligned onto the processing tray 205 slides while being pressed onto the processing tray 205 by the claws 249 and is ejected onto the tray 154, the tray sheet pressing member 251 presses the sheet bundle which has already been stacked on the tray 154 onto the tray 154.

Before the sheet bundle drops onto the tray 154, the tray sheet pressing member 251 rotates upward. The tray sheet pressing member 251 enters a lower space 205*c* (FIG. 1) of the processing tray 205 and retreats. That is, the tray sheet pressing member 251 is retracted into the sheet processing apparatus 300. Thus, the tray sheet pressing member 251 does not obstruct such an operation that the subsequent sheet bundle drops onto the tray 154.

When the sheet bundle drops onto the tray 154, the tray sheet pressing member 251 rotates downward and presses the sheet bundle on the tray 154 onto the tray 154.

(Description of Whole Operation of Sheet Processing Apparatus)

Figure 10:
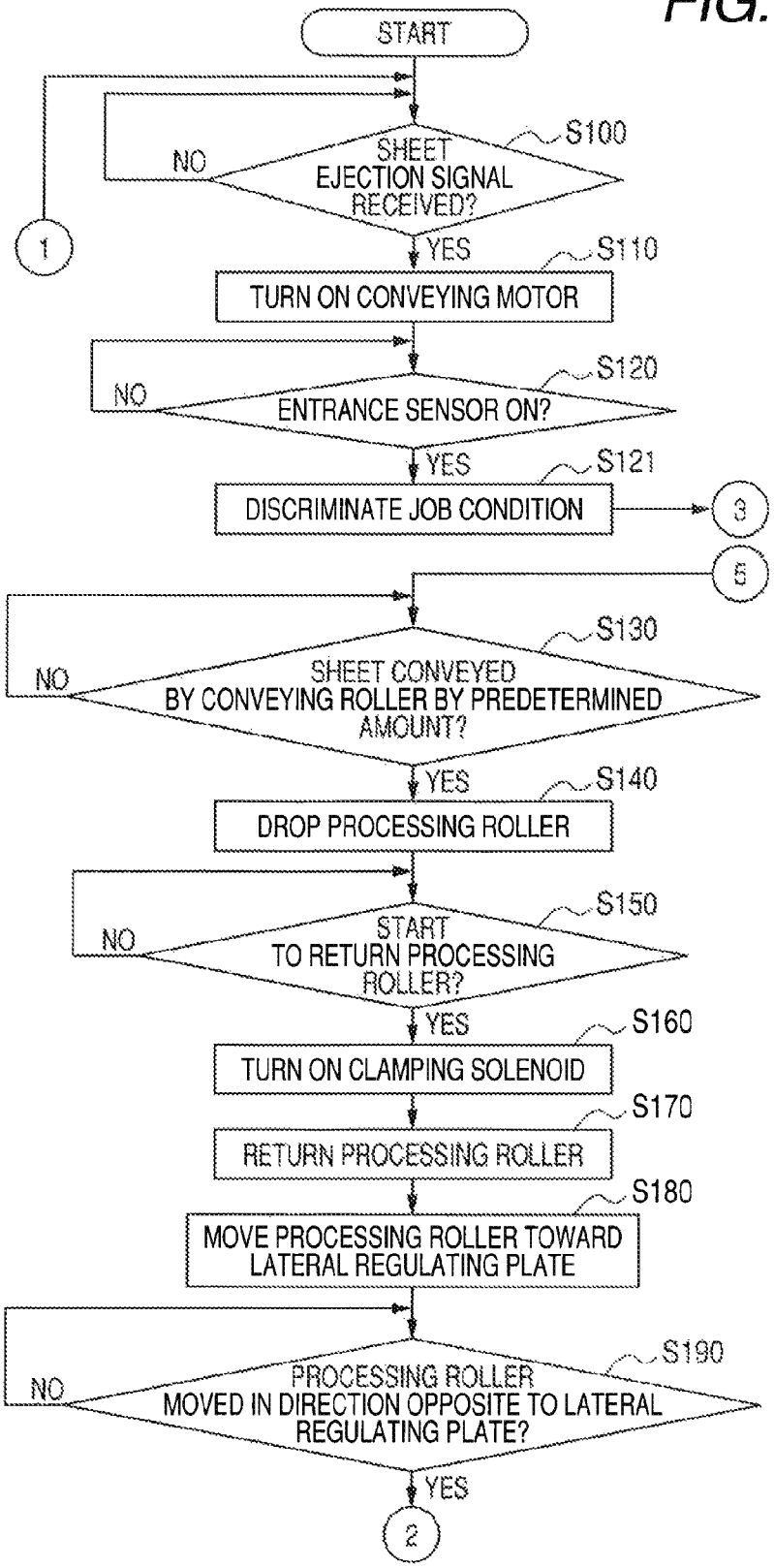
FIG. 10 is a flowchart for describing the operation of the image forming apparatus.
Figure 12:
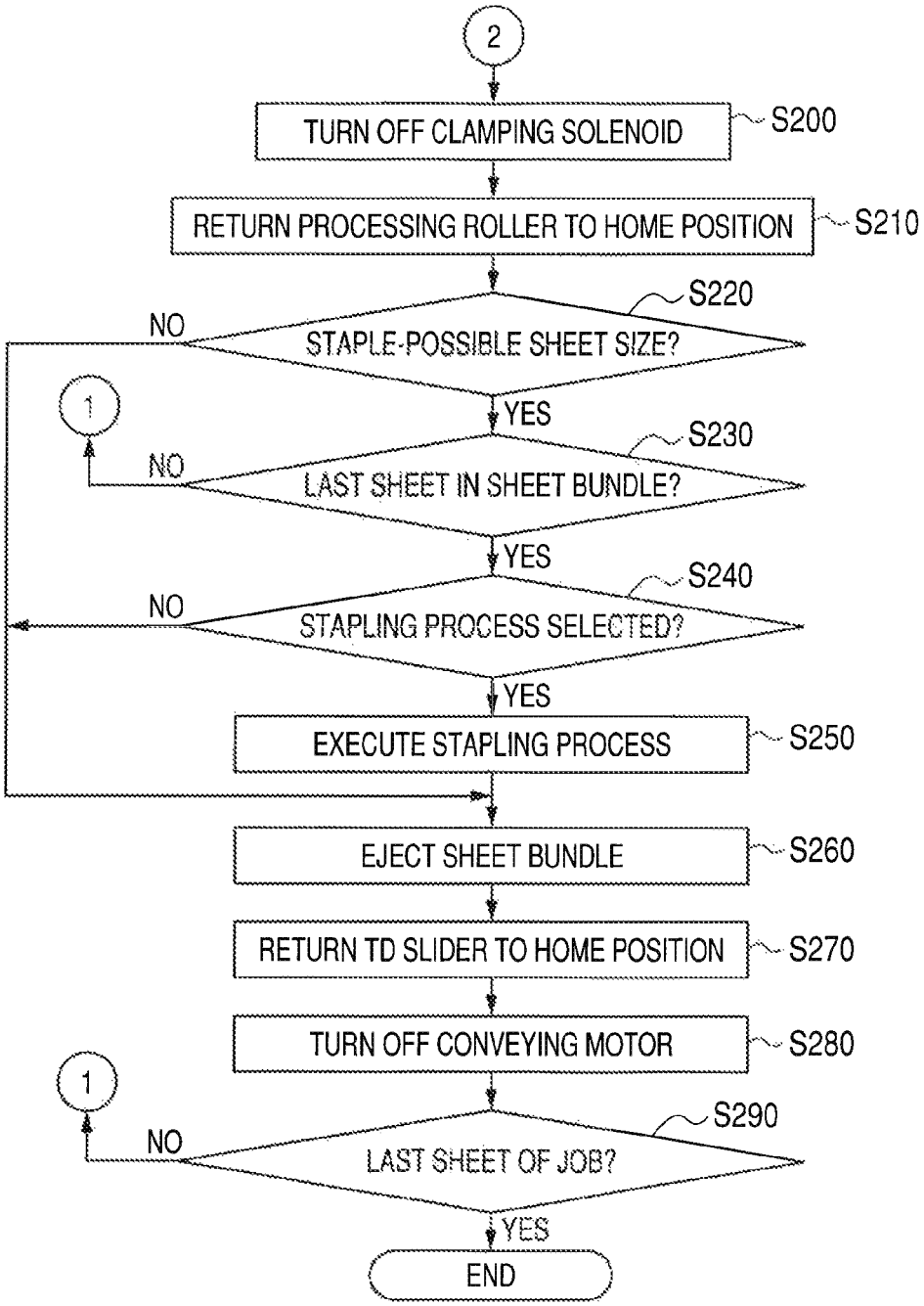
FIG. 12 is a flowchart sequel to FIG. 11.

Subsequently, the sheet processing operation of the sheet processing apparatus 300 in the embodiment constructed as mentioned above will be described with reference to constructional diagrams of FIGS. 1 to 8, a control block diagram of FIG. 9, and flowcharts illustrated in FIGS. 10 and 12.

When the image forming operation is started in the apparatus main body 150A of the image forming apparatus, the CPU 100 (FIG. 1) of the sheet processing apparatus 300 discriminates whether or not a sheet ejection signal has been received from the control unit 140 of the apparatus main body 150A (step S100). If the sheet ejection signal has been received (YES in S100), the CPU 100 turns on the conveying motor 206 (FIG. 4) (S110). The conveying roller pair 203 provided on the guide path 268 (FIG. 1) conveys the sheet in the sheet ejecting direction of the apparatus main body 150A.

The entrance sensor 202 (FIG. 2) detects a leading edge of the first sheet and is turned on (YES in S120). After that, the sheet reaches the conveying roller pair 203. Therefore, the sheet is conveyed to the conveying roller pair 203 and is away from the discharge roller pair 153 (FIG. 1) of the apparatus main body 150A. Thus, the reception and removal of the sheet are completed.

When the sheet which is conveyed to the sheet processing apparatus 300 is the first sheet of a job, the control unit 140 of the image forming apparatus notifies the CPU 100 of the sheet processing apparatus 300 of such a fact. The CPU 100 enters a job condition discriminating process for discriminating whether or not the reciprocating operation of the sheet is executed by the conveying roller pair 203 (S121). At this time, the CPU 100 also receives sheet information regarding the sheet such as sheet size information, print ratio information, process information about whether or not the sheets are stapled in a bundle shape, and the like from the control unit 140 of the image forming apparatus.

The CPU 100 discriminates whether or not the sheet relates to the first job after the start of the image forming apparatus. If the sheet relates to the first job (YES in S122), the processing routine advances to step S124. If it does not relate to the first job, (NO in S122), the processing routine advances to step S123. Since the image forming apparatus is now (present job) in a state just after the start of the operation, the job is the first job and the processing routine advances to step S124.

The CPU 100 discriminates whether or not a temperature of the fixing device 266 detected by the fixing temperature sensor 257 (FIG. 1) is equal to or higher than a predetermined temperature (T° C.) (S124). If the temperature of the fixing device 266 is equal to or higher than T° C., the CPU 100 discriminates whether or not a print ratio at a predetermined image position having an arbitrary area obtained from the control unit 140 of the image forming apparatus is equal to or larger than a predetermined value (S125). If the print ratio of the image formed on the sheet is equal to or larger than the predetermined value (YES in S125), the CPU 100 controls the conveying motor 206 (FIG. 2) so that the conveying roller pair 203 is forwardly or reversely rotated. After the sheet reciprocated, it is ejected onto the processing tray 205 (S126). If the print ratio at the predetermined image position having the arbitrary area is less than the predetermined value, the CPU 100 allows the conveying motor 206 (FIG. 2) to rotate in one direction. The sheet is ejected without reciprocating (S127). As an example of the predetermined image position, there is a region where the conveying roller pair 203 is come into contact with the sheet.

In step S124, if the temperature of the fixing device 266 is lower than the predetermined temperature (T° C.) (NO in S124), the CPU 100 discriminates whether or not the number (n) of sheets of the present job counted by the sheet number counter 123 (FIG. 9) exceeds a predetermined number N of sheets (S128). If the number (n) of sheets exceeds the predetermined number N (YES in S128), the CPU 100 advances to steps S125 and S126.

After steps S126 and S127, the CPU 100 advances to step S130.

After that, the CPU 100 executes processes in step S130 and subsequent steps. If NO in step S230, the processing routine is returned to step S100. If YES in step S230, the CPU 100 executes processes in step S240 and subsequent steps, which will be described hereinafter. If YES in step S230 and if YES in step S290, the job is finished. In the case of executing the next job here, the CPU 100 executes a discriminating process in step S122 through step S120. Since the present job is not the first job, the processing routine advances to step S123. The CPU 100 allows the time counter 122 to count a time interval between the last sheet of the previous (preceding) job and the first sheet of the present (subsequent) job and discriminates whether or not the counted time interval is equal to or longer than a predetermined time t (S123).

If the time interval between the jobs is shorter than the predetermined time t (NO in S123), there is a relation of (m+n>N) between the number (m) of sheets of the previous job and the number (n) of sheets of the present job (YES in S129), and the print ratio at the predetermined image position is equal to or larger than the predetermined value (YES in S125), the CPU 100 allows the sheet to reciprocate by the conveying roller pair 203 (S126). After that, the CPU 100 executes processes in step S130 and subsequent steps. As for the number (m) of sheets of the previous job, if the time interval between the previous job and the job before the previous job is less than the predetermined time t, the number of sheets in such a case is also accumulated and the resultant number is assumed to be m.

If the time of t seconds or longer has passed from the previous job (YES in S123), the temperature of the fixing device 266 just before the start of the job is lower than T° C. (NO in S124), n>N with respect to the number (n) of sheets of the present job (YES in S128), and the print ratio at the predetermined image position is equal to or larger than the predetermined value (YES in S125), the CPU 100 allows the sheet to reciprocate by the conveying roller pair 203 (S126). After that, the CPU 100 executes processes in step S130 and subsequent steps.

The reason why the discrimination about whether or not the time of t seconds or longer has passed from the previous job is made in step S123 mentioned above is as follows. In other words, if the time interval is shorter than t seconds, that is, at the timing just after the end of the previous job, since the present job is close to the continuous jobs sequel to the previous job, whether or not the time of t seconds or longer has passed from the previous job is discriminated. In a range where the number of sheets among the continuous jobs (the jobs whose time intervals are shorter than t seconds from the previous job are also included) does not exceed N, the sheet temperature is low and the discharge adhesion does not occur. Therefore, the reciprocating operation by the conveying roller pair 203 is not executed. The number N of sheets is set to such a value that the discharge adhesion is not caused irrespective of the image state.

The time shorter than t seconds is an interval time of the sheets in the job. If the time of t seconds or longer has passed from the preceding sheet, the subsequent sheets are the sheets of the job different from that of the preceding sheet. Therefore, if the time of t seconds or longer has passed from the previous job (YES in S123), the sheet is not the sheet of the same job. Consequently, when the sheet of the next job is fed to the fixing device after the elapse of t seconds or longer, the temperature of the fixing device ought to have been reduced. However, if the sheets continuously passed through the fixing device, a temperature of the atmosphere around the fixing device rises gradually by the heated sheets. The larger the number of sheets which continuously pass is, the more the temperature of the atmosphere around the fixing device is liable to rise. Therefore, the temperature of the fixing device is controlled so as to be high when the first sheet of the job passes and be low after that. However, there is a case where even after the sheet of one job completely passed through the fixing device, the temperature of the fixing device is not perfectly reduced. Therefore, even in the case of the sheet of the next job, it is necessary that whether or not the temperature of the fixing device just before the start of the job is equal to or higher than T° C. is discriminated (S124) at an interval of t seconds or longer (S123).

The temperature of the fixing device just before the start of the job will be described.

First, when a power source of the image forming apparatus is turned on, the temperature of the fixing device rises to a first temperature. When a start key of the image forming apparatus is pressed, in order to fix the toner image onto the sheet, the temperature of the fixing device rises to a second temperature at which the toner image can be fixed onto the sheet. The first temperature in such a temperature change is called a temperature of the fixing device just before the start of the job.

After that, when the operation to continuously fix the toner images onto a plurality of sheets is finished, the temperature of the fixing device drops from the second temperature to the first temperature. If the power source of the image forming apparatus is held on, the temperature of the fixing device is held at the first temperature. When the start key of the image forming apparatus is pressed again, the temperature of the fixing device rises to the second temperature and the fixing device fixes the toner image onto the conveyed sheet. The first temperature in such a temperature change is called a temperature of the fixing device just before the start of the job.

When the operation to continuously fix the toner images onto a plurality of sheets is finished, the temperature of the fixing device drops from the second temperature to the first temperature. However, there is a case where if the start key of the image forming apparatus is pressed during the reduction in temperature of the fixing device, the temperature of the fixing device does not decrease to the first temperature but rises from a third temperature to the second temperature. In this case, the third temperature is called a temperature of the fixing device just before the start of the job. The third temperature is an intermediate temperature between the first temperature and the second temperature.

The print ratio of the toner image at the predetermined image position is discriminated by the control unit 140 of the apparatus main body of the image forming apparatus. It is desirable to set the predetermined image position to a position where the image of the high print ratio exists there and the discharge adhesion occurs when the sheet temperature is high. It is also desirable to set the print ratio to a print ratio at which the discharge adhesion occurs when the sheet temperature is high.

After that, when the conveying roller pair 203 (FIG. 6A) conveys the sheet to the processing tray 205, the CPU 100 allows the conveying roller pair 203 to convey the sheet by a predetermined amount (YES in S130). Before the sheet perfectly exits from the conveying roller pair 203, the CPU 100 allows the TD motor 216 to rotate, thereby dropping the processing roller 204. The processing roller 204 moves to the downstream side and conveys the sheet to the downstream side in cooperation with the conveying roller pair 203 (FIG. 6B) (S140). After that, when the sheet exits from the conveying roller pair 203, only the processing roller 204 conveys the sheet S to the downstream side.

The processing roller 204 starts the operation to return the sheet to the upstream side (YES in S150). Just before the sheet is started to be returned to the upstream side, the CPU 100 turns on the clamping solenoid 240 (S160), thereby rotating the claw axis 241 so as to rotate the claws 241*a* upward. After that, the processing roller 204 moves to the upstream side, returns the sheet to the upstream side, and allows the trailing edge of the sheet to hit the trailing edge restricting plate 242 (FIG. 7B) (S170). Thus, the trailing edge of the sheet S is aligned.

A movement amount of the processing roller 204 at the time when the trailing edge of the sheet is allowed to hit the trailing edge restricting plate 242 is set in consideration of an oblique motion of the sheet S that is caused when the sheet is conveyed from the apparatus main body 150A. That is, the movement amount of the processing roller is set in such a manner that the sheet is conveyed by a slightly larger amount than a distance from the maximum movement point where the conveyance of the sheet S sent from the apparatus main body is stopped and a switch-back (movement in the direction opposite to the sheet ejecting direction) is started to the trailing edge restricting plate 242.

Therefore, after the sheet S was conveyed by the processing roller 204 by the distance adapted to be come into contact with the trailing edge restricting plate 242, the sheet is also conveyed for a predetermined time. Thus, the sheet S is certainly come into contact with the trailing edge restricting plate 242. After the sheet S was come into contact with the trailing edge restricting plate 242, the processing roller 204 also moves and slides on the sheet.

Subsequently, the CPU 100 allows the rotation of the TD motor 216 to be continued and allows the processing roller 204 to be moved toward the lateral regulating plate 239 (S180), thereby allowing a side edge of the sheet S to hit the lateral regulating plate 239. After that, the processing roller 204 slides on the sheet. Thus, the side edge of the sheet S is aligned.

The CPU 100 allows the processing roller holder 211 to rotate upward and allows the processing roller 204 to move upward so as to be removed from the sheet. After that, the processing roller 204 moves in such a direction as to be away from the lateral regulating plate 239 in a state where it is away from the sheet upward (YES in S190). The CPU 100 turns off the clamping solenoid 240 (S200). The claws 241*a* (FIG. 2) rotate downward and presses the aligned sheet S onto the processing tray 205, thereby preventing the alignment from being disturbed.

Thus, such a situation that the sheet S which has been ejected out first is fed together by the sheet which is subsequently ejected can be prevented. The processing roller 204 is returned to the home position (S210). Consequently, a series of aligning operation to the first sheet S is completed.

The CPU 100 discriminates whether or not a size of sheets S stacked on the processing tray 205 is equal to a size at which the sheets can be stapled (S220). If the CPU 100 determines that the sheet size is the size at which the sheets cannot be stapled based on information transmitted from the apparatus main body 150A of the image forming apparatus (NO in S220), bundle ejection and movement (S260), which will be described hereinafter, and the subsequent operations are executed.

If the CPU 100 determines in step S220 that the sheet size is the size at which the sheets can be stapled, the CPU 100 discriminates whether or not the sheet is the sheet of the last page in the sheet bundle (S230). If the CPU 100 determines that the sheet is not the last sheet in the sheet bundle based on the information transmitted from the apparatus main body 150A (NO in S230), the processing routine is returned to step S100. The CPU 100 repeats the processes of steps S100 to S230 until the sheet ejection signal transmitted from the apparatus main body 150A is received and the last sheet S in the sheet bundle is enclosed onto the processing tray 205.

If the CPU 100 determines in step S230 that the sheet is the last sheet in the sheet bundle (YES in S230), this means that the sheet bundle has been formed on the processing tray 205. Therefore, the CPU 100 discriminates whether or not a stapling process has been selected (S240). If the stapling process has been selected (YES in S240), the CPU 100 drives the stapler unit 254 (FIG. 1) and executes the stapling process at the stapling position (S250).

If the stapling process is not selected (NO in S240) or if the stapling process has been completed, the CPU 100 allows a sheet bundle SA to be moved toward the tray 154 in a state where the sheet bundle SA has been pressed by the claws 249 from an upper portion, and allows the sheet bundle SA to be ejected onto the tray 154 (S260).

Finally, the CPU 100 stops the conveying motor 206 (S280). In step S290, the CPU 100 discriminates whether or not the sheet is the last sheet of the job. If the sheet is the last sheet of the job (YES in S290), the sheet processing apparatus 300 finishes the series of processes. If NO in S290, the processing routine is returned to step S100.

In the above description, the sheet processing apparatus allows the sheet to reciprocate based on the sheet information indicative of the temperature of the fixing device, the print ratio, and the sheet number of the job. However, the invention is not limited to such a method but it is also possible to construct in such a manner that the sheet temperature is measured by the fixing temperature sensor 257 and when the measured temperature is equal to or higher than a predetermined temperature, the reciprocating operation of the sheet is executed. In such a case, the fixing temperature sensor 257 is an example of the sheet temperature measuring unit. The reciprocating operation of the sheet may be executed based on at least one of the sheet information indicative of the temperature of the fixing device, the print ratio, the sheet number of the job, and the sheet temperature. Further, the reciprocating operation of the sheet may be executed irrespective of those sheet information.

Figure 11:
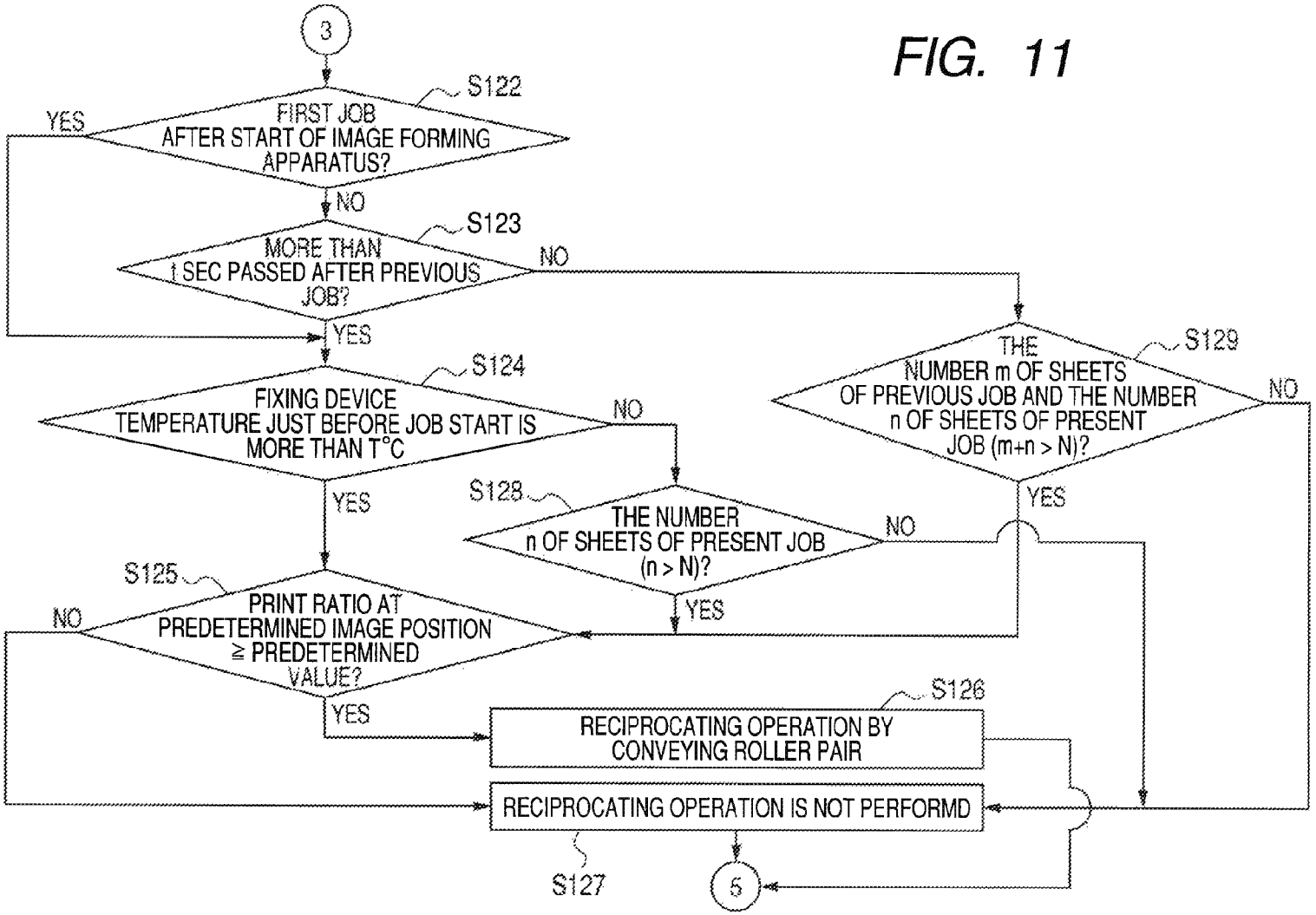
FIG. 11 is a flowchart sequel to FIG. 10.

Although the sheet is cooled by allowing the sheet to execute the reciprocating operation in the embodiment, a similar cooling effect can be also obtained by such a repeating operation that the sheet is conveyed in the ejecting direction and stopped (300 msec or shorter) by the conveying roller pair 203 in place of step S126 (FIG. 11). That is, the sheet can be also intermittently conveyed and ejected to the processing tray 205 by allowing the conveying roller pair 203 to repeat the rotation and the rotation stop. Also in this case, the intermittent conveyance of the sheet may be executed based on at least one of the sheet information indicative of the temperature of the fixing device, the print ratio, the sheet number of the job, and the sheet temperature. Further, the intermittent conveyance of the sheet may be executed irrespective of those sheet information.

Particularly, the operation for cooling and ejecting the sheet is effective to prevent the adhesion in the case where the sheets are bound and their toner images are liable to be adhered as in the case of a stapling mode in which the sheets are stapled in a bundle form by the stapler 254 (FIG. 1).

Although the foregoing image forming apparatus has the sheet processing apparatus 300, if the sheet processing apparatus 300 is not equipped, it is also possible to construct in such a manner that the discharge roller pair 153 is allowed to execute the reciprocating operation of the sheet in a manner similar to the conveying roller pair 203 and the sheet is cooled and ejected to the tray 154. In such a case, the discharge roller pair 153 becomes the ejecting unit and the rotor pair. The tray 154 becomes the stacking unit. A belt pair may be used in place of the discharge roller pair 153. Therefore, the rotor pair is not limited to the roller pair.

Further, it is necessary that a time necessary to eject the sheet by the conveying roller pair 203 or discharge roller pair 153 adapted to reciprocate or intermittently convey the sheet is set to be longer than the ordinary ejection time necessary when the roller pairs 203 and 153 eject the sheet in one direction at a predetermined speed. The operation for ejecting the sheet in one direction at the predetermined speed is similar to the sheet ejection which has been executed in the related art.

The ordinary necessary ejection time is a necessary time at the time when the sheet is ejected in one direction at the predetermined speed. However, actually, the sheet is not always ejected at the predetermined speed. That is, the sheet is accelerated when it is conveyed by the conveying roller pair 203 from a state where the sheet is conveyed by the discharge roller pair 153 and the conveying roller pair 203. The sheet is decelerated when the ejection of the sheet from the guide path 268 to the processing tray 205 by the conveying roller pair 203 is finished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-238590, filed Sep. 13, 2007, which is hereby incorporated by reference herein in its entirety.

What is claimed is:

1. A sheet processing apparatus comprising:

a stacking unit on which a sheet is stacked;

an ejecting unit that ejects a sheet, on which a toner image has been heated and fixed, onto the stacking unit;

a processing unit that processes a sheet ejected by the ejecting unit; and a control unit configured to control the ejecting unit, wherein the control unit controls the ejecting unit to bring a sheet into a state in which the sheet overlaps with the stacking unit over the stacking unit, and in the state in which the sheet overlaps with the stacking unit over the stacking unit, the control unit causes the ejecting unit to execute a reciprocating operation of the sheet and then to eject the sheet onto the stacking unit, and wherein the control unit causes the ejecting unit to stop the sheet for a predetermined time in the reciprocating operation of the sheet while the sheet is in the state in which the sheet overlaps with the stacking unit over the stacking unit, the predetermined time being set so that the predetermined time is sufficient to prevent the sheet from adhering to a preceding sheet stacked on the stacking unit.

2. A sheet processing apparatus according to claim 1, wherein the processing unit is a stapler for binding a sheet, and the ejecting unit executes the reciprocating operation.

3. A sheet processing apparatus according to claim 1, wherein the control unit controls the ejecting unit based on information of a fixing temperature measured by a fixing temperature measuring unit, and when the fixing temperature based on the information of the fixing temperature is equal to or higher than a predetermined temperature, the control unit causes the ejecting unit to execute the reciprocating operation.

4. A sheet processing apparatus according to claim 1, wherein the control unit controls the ejecting unit based on temperature information of a sheet, on which a toner image has been heated and fixed, measured by a sheet temperature measuring unit, and when a temperature of the sheet based on the temperature information of the sheet is equal to or higher than a predetermined temperature, the control unit causes the ejecting unit to execute the reciprocating operation.

5. A sheet processing apparatus according to claim 1, wherein the control unit controls the ejecting unit based on print ratio information of a toner image, which is formed on a sheet, to be discriminated by a print ratio discriminating unit, and when a print ratio based on the print ratio information is equal to or higher than a predetermined print ratio, the control unit causes the ejecting unit to execute the reciprocating operation.

6. A sheet processing apparatus according to claim 5, wherein the print ratio is a print ratio at a predetermined image position.

7. A sheet processing apparatus according to claim 1, wherein the control unit controls the ejecting unit based on information of the number of sheets to be counted by a counting unit, and in a case that the number of sheets based on the information of the number of sheets is equal to or larger than a predetermined number of sheets, the control unit causes the ejecting unit to execute the reciprocating operation.

8. A sheet processing apparatus according to claim 7, wherein the predetermined number of sheets is the number of sheets based on the first sheet of a job as a reference.

9. An image forming apparatus comprising:

an image forming unit that forms a toner image onto a sheet;

a fixing unit that fixes a toner image, which is formed on a sheet by the image forming unit, onto the sheet by heating; and the sheet processing apparatus according to claim 1.

10. A sheet processing apparatus according to claim 1, wherein the ejecting unit is a rotor pair which is positioned above the stacking unit and which is capable of nipping and conveying a sheet.

11. A sheet processing apparatus according to claim 1, wherein the processing unit is a binding unit which performs a binding operation for the sheet stacked on the stacking unit, and the control unit causes the binding unit to perform the binding operation for the sheet stacked on the stacking unit after the control unit causes the ejecting unit to execute the reciprocating operation of the sheet and then to eject the sheet onto the stacking unit.

12. A sheet processing apparatus according to claim 1, wherein the control unit causes the ejecting unit to eject the sheet, which is not reversed after the reciprocating operation, onto the stacking unit.

13. An image forming apparatus comprising:

an image forming unit that forms a toner image onto a sheet;

a fixing unit that fixes the toner image, which is formed on a sheet by the image forming unit, onto the sheet by heating;

a stacking unit on which a sheet is stacked;

an ejecting unit that ejects a sheet, on which a toner image has been fixed by the fixing unit, onto the stacking unit; and a control unit configured to control the ejecting unit, wherein the control unit controls the ejecting unit to bring a sheet into a state in which the sheet overlaps with the stacking unit over the stacking unit, and in the state in which the sheet overlaps with the stacking unit over the stacking unit, the control unit causes the ejecting unit to execute a reciprocating operation of the sheet and then to eject the sheet onto the stacking unit, and wherein the control unit causes the ejecting unit to stop the sheet for a predetermined time in the reciprocating operation of the sheet while the sheet is in the state in which the sheet overlaps with the stacking unit over the stacking unit, the predetermined time being set so that the predetermined time is sufficient to prevent the sheet from adhering to a preceding sheet stacked on the stacking unit.

14. An image forming apparatus according to claim 13, further comprising:

a fixing temperature measuring unit that measures a fixing temperature of the fixing unit, wherein the control unit obtains a fixing temperature from the fixing temperature measuring unit, and in a case that the fixing temperature is equal to or higher than a predetermined temperature, the control unit causes the ejecting unit to execute the reciprocating operation.

15. An image forming apparatus according to claim 13, further comprising:

a sheet temperature measuring unit that measures a temperature of a sheet, wherein the control unit obtains a temperature of a sheet from the sheet temperature measuring unit, and in a case that the temperature of the sheet is equal to or higher than a predetermined temperature, the control unit causes the ejecting unit to execute the reciprocating operation.

16. An image forming apparatus according to claim 13, further comprising:

a print ratio discriminating unit that discriminates a print ratio of a sheet, wherein the control unit obtains print ratio from the print ratio discriminating unit, and in a case that the print ratio is equal to or larger than a predetermined print ratio, the control unit causes the ejecting unit to execute the reciprocating operation.

17. An image forming apparatus according to claim 13, further comprising:

a counting unit that counts the number of sheets on which the toner images have been formed by the image forming unit, wherein the control unit obtains information of the number of sheets from the counting unit, and in a case that the number of sheets is equal to or larger than a predetermined number of sheets, the control unit causes the ejecting unit to execute the reciprocating operation.

18. An image forming apparatus according to claim 13, wherein the ejecting unit is a rotor pair which is positioned above the stacking unit and which is capable of nipping and conveying a sheet.

19. A sheet processing apparatus according to claim 13, wherein the control unit causes the ejecting unit to eject the sheet, which is not reversed after the reciprocating operation, onto the stacking unit.

20. An image forming apparatus comprising:

an image forming unit that forms a toner image onto a sheet;

a fixing unit that fixes the toner image, which is formed on a sheet by the image forming unit, onto a sheet by heating;

a stacking unit on which a sheet is stacked;

an ejecting unit that ejects a sheet, on which a toner image has been fixed by the fixing unit, onto the stacking unit; and a control unit configured to control the ejecting unit, wherein the control unit controls the ejecting unit so as to bring a sheet into a state in which the sheet overlaps with the stacking unit over the stacking unit, and when in the state in which the sheet overlaps with the stacking unit over the stacking unit, the control unit causes the ejecting unit to execute an operation of the sheet in which sheet conveyance in an ejecting direction and a subsequent stoppage of sheet conveyance are repeated, and wherein the control unit is configured to control the ejecting unit so as not to convey the sheet in a direction opposite to the ejecting direction after each of the subsequent stoppage of sheet conveyance.

21. An image forming apparatus according to claim 20, wherein the ejecting unit is a rotor pair which is positioned above the stacking unit and which is capable to nip and convey a sheet.

22. An image forming apparatus according to claim 20, wherein the control unit causes the ejecting unit to stop the sheet during a predetermined time in the operation of the sheet, the predetermined time being set so that the sheet is prevented from adhering to a preceding sheet stacked on the stacking unit during the predetermined time.

23. A sheet processing apparatus comprising:

a stacking unit on which a sheet is stacked;

an ejecting unit that ejects a sheet, on which a toner image has been heated and fixed, onto the stacking unit;

an aligning unit which aligns the sheet ejected onto the stacking unit by the ejecting unit; and a control unit configured to control the ejecting unit and the aligning unit, wherein the control unit controls the ejecting unit to bring a sheet into a state in which the sheet overlaps with the stacking unit over the stacking unit, and in the state in which the sheet overlaps with the stacking unit over the stacking unit, the control unit causes the ejecting unit to execute a reciprocating operation of the sheet and then to eject the sheet onto the stacking unit, the control unit causes the aligning unit to align the sheet ejected onto the stacking unit, and the control unit causes the ejecting unit to stop the sheet for a predetermined time in the reciprocating operation of the sheet while the sheet is in the state in which the sheet overlaps with the stacking unit over the stacking unit, the predetermined time being set so that the predetermined time is sufficient to prevent the sheet from adhering to a preceding sheet stacked on the stacking unit.

24. A sheet processing apparatus according to claim 23, further comprising:

a binding unit, wherein the control unit causes the binding unit to perform a binding operation for the sheet stacked on the stacking unit, after the control unit causes the ejecting unit to execute the reciprocating operation of the sheet and then to eject the sheet onto the stacking unit.

25. A sheet processing apparatus according to claim 23, wherein the ejecting unit is a rotor pair which is positioned above the stacking unit and which is capable to nip and convey a sheet.

* * * * *